United States Patent [19]

Halverson

[11] Patent Number: 4,735,147

[45] **Date of Patent: * Apr. 5, 1988**

[54] AMMUNITION SABOT AND PROJECTILE

[75] Inventor: Henry J. Halverson, Collinsville, Ill.

[73] Assignee: Olin Corporation, Stamford, Conn.

[ * ] Notice: The portion of the term of this patent subsequent to Mar. 11, 2003 has been disclaimed.

[21] Appl. No.: 705,957

[22] Filed: Feb. 27, 1985

Related U.S. Application Data

[63] Continuation-in-part of Ser. No. 585,327, Mar. 1, 1984, Pat. No. 4,574,703.

[51] Int. Cl.[4] ..... F42B 13/16

[52] U.S. Cl. ..... 102/520; 102/522

[58] Field of Search ..... 102/458, 513, 520–523, 102/532

[56] References Cited

U.S. PATENT DOCUMENTS

| | | | |
|---|---|---|---|
| 2,382,152 | 8/1945 | Jakobsson | 102/523 |
| 3,011,404 | 12/1961 | Russell | 102/521 |
| 3,496,869 | 2/1970 | Engel | 102/522 |
| 3,507,221 | 4/1970 | Grolly | 102/523 |
| 3,771,458 | 11/1973 | Schweimler | 102/523 |
| 4,488,491 | 12/1984 | Rhodes | 102/522 |
| 4,505,204 | 3/1985 | Wikstrom | 102/523 |
| 4,653,404 | 3/1987 | Halverson | 102/522 |

*Primary Examiner*—Harold J. Tudor

*Attorney, Agent, or Firm*—Bruce E. Burdick

[57] ABSTRACT

A high velocity traced armor penetrating subcaliber projectile core having sealed radial spin-up notches on its base is disclosed. Also disclosed, is a plastic sabot for launching a traced subcaliber high velocity armor penetrating projectile core, which sabot is a cup shaped plastic body with a sealed passageway through its base and longitudinal weakening slots on the inside of its walls, the slot extending only part way down the inner surface of the wall to leave a cylindrical sealing surface adjacent the sabot base, whereby to provide a waterproof seal surrounding the rearend of the core and the tracer charge.

18 Claims, 1 Drawing Sheet

AMMUNITION SABOT AND PROJECTILE

This application is a continuation-in-part of my earlier co-pending patent application Ser. No. 06/585,327, filed Mar. 1, 1984 and issued Mar. 11, 1986 as U.S. Pat. No. 4,574,703 entitled "High Velocity Ammunition Sabot", which is incorporated herein by reference as if set forth at length.

This invention was not developed with government funds.

The present invention relates to a subcaliber projectile and an ammunition sabot and a combination of the projectile and sabot.

Within the past year, Winchester (Winchester Group, Olin Corporation) has successfully developed a 0.50 Caliber High Velocity Saboted Light Armor Penetrating round which has significantly advanced the armor penetrating capability of the 0.50 Caliber Weapon System currently in use by most of the world's armies. The sabot for that ammunition round is the subjct matter of my parent application, Ser. No. 06/585,327. In order to utilize such improved ammunition to its fullest effectiveness, it is necessary to have a tracer ammunition round for aiming purposes. Prior to this invention there was no such tracer round capable of matching the trajectory and time of flight of the 0.50 Caliber Saboted Light Armor Penetrating round.

The invention will be better understood by reference to the attached drawing, comprising five (5) figures, in which.

Figure 1:
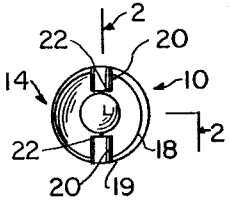
FIG. 1 is a rear view of a tracer projectile according to the invention.
Figure 2:
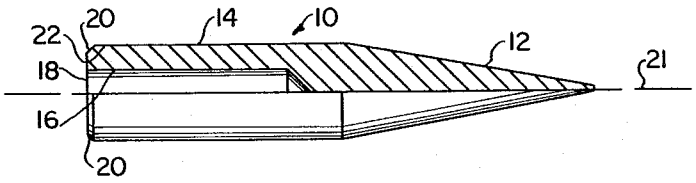
FIG. 2 is a side view, partially in cross section, taken along line 2—2 of FIG. 1.

Referring first to FIGS. 1 and 2, a subcaliber projectile 10 is shown which has a tapered front end or nose 12 and a cuff-like rear portion 14 defining a rearwardly opening cylindrical cavity 16. The rear end surface 18 of the projectile core 10 is provided with two radial spin-up notches 20 located 180° apart and symmetrical with respect to the axis 21 of the projectile. The spin-up notches 20 lie at an angle with respect to the axis 21 rather than perpendicular as is conventional. Also, notches 20 only extend partially across the rear end surface 18 of the projectile core so that the notches 20 terminate radially outward of the tracer cavity 16 so as to provide a continuous annular seal 22 about the tracer cavity 16. The rear end surface 18 of the projectile core can also preferably have a chamfer 19 adjacent the periphery of the projectile core. Core 10 is made of a heavy hard metal such as tungsten, tungsten alloy, or tungsten carbide and is given an aerodynamic profile such as the conical nose and cylindrical body shown which also increases the sectional density at impact so as to improve penetration capabilities.

Figure 3:
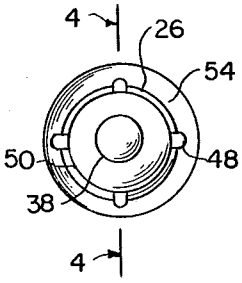
FIG. 3 is a top view of a preferred embodiment of a sabot of the invention.
Figure 4:
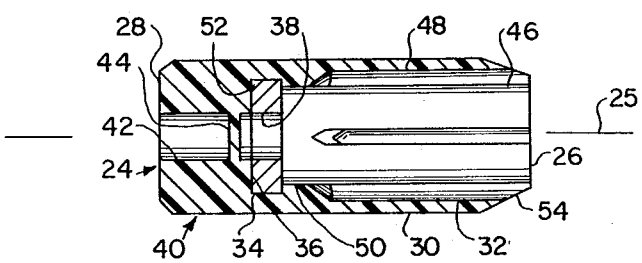
FIG. 4 is a side cross sectional view taken along line 4—4 of FIG. 3.

Looking now to FIGS. 3 and 4, a plastic sabot 24 is shown having a longitudinal axis 25 about which the sabot 24 is symmetrical in order to provide ballistic stability. Sabot 24 has a front end 26, a rear end 28 and comprises a front cylindrical wall portion 30, a cylindrical base 36 and a support plate 34. The inner surface of wall 30 defines a cylindrical cavity 32 adapted to receive hence around the rear portion 14 of core 10. Support plate 34 is located at the base of cavity 32 and is oriented orthogonal to the axis 25 of sabot 24 and serves as the base 36 of the cavity 32. The purpose of support plate 34 is to increase the annular area of contact between the rear surface 18 of core 10 and the base 36 of cavity 32 to distribute the forces of set-back of the penetrator during in-bore acceleration which might otherwise force core 10 rearwardly through base 40. In addition, support plate 34 serves to increase the amount of torque which can be applied by sabot 24 to core 10 and to this end support plate 36 is preferably made of relatively soft metal such as aluminum which will upset in to grooves 20 in response to the set-back forces at launch. Base 40 and support plate 34 are coaxially aligned and are provided with coaxially aligned passageways 38 and 42 which are of a diameter slightly less than the diameter of tracer cavity 16 so that support plate 34 can also support any tracer charge placed within cavity 16, if desired. A membrane or barrier 44 is provided in passageway 42 so as to seal (e.g. waterproof) the remainder of passageway 42 and passageway 38 from the environment when a projectile core 10 is in place within sabot 24. Membrane 44 is broken by propellant gases pressure and flame front during launch from a gun thereby allowing flame front and pressure to ignite ignitor 57 (see FIG. 5) in tracer cavity. Cylindrical wall 30 is provided with a plurality of longitudinal notches 48 which form weakened sections of wall 30 and divide wall 30 into a plurality of petals 46, each lying between a pair of longitudinal notches 48. Notches 46 extend from the front end 26 to a point forward of the base 36 of cavity 32 so as to leave a continuous cavity seal surface 50 adjacent to base 32 so as to seal the rear surface 18 and the tracer cavity 16 of a core 10 when placed within sabot 24. In order to predetermine the location at which petals 46 will break due to centrifugal forces following launch, wall 30 can be provided with a circumferential notch 52 adjacent the rear end of petal and disposed on the inner surface of wall 30. Notch 52 also is adapted to hold support plate 34. The wall 30 and base 40 of sabot 24 is made of a plastic material that has sufficient tensile strength (at least 12,000 psi when tested under the standard ASTM Test Method D1708), compressive strength (at least 15,000 psi when tested under the standard ASTM Test Method D659), and sufficient shear strength (at least 12,000 psi when tested under standard ASTM Test Method D732) to withstand the shock of explosive discharge from a rifled gun barrel while carrying projectile core 10 but having insufficient IZOD impace strength (less than about 12 ft.-lbs/in. when tested under standard ASTM Test Method D256) to withstand the centrifugal and aerodynamic forces following discharge so that sabot 24 disintegrates immediately (i.e. with a yard) after exiting the barrel muzzle, thus, immediately freeing the projectile core 10 for further unimpeded flight to the target. Wall 30 is also provided with a tapered front portion 44. The cylindrical wall 30 and base 40 of sabot 24 are preferably made of a high strength engineering plastic such as Ultem 1000, a polyetherimide resin marketed by General Electric Corporation.

Figure 5:
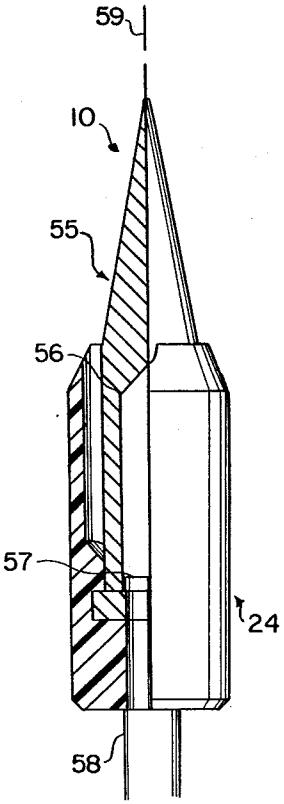
FIG. 5 is a side view in partial cross section showing an assembled projectile and sabot according to the invention.

Referring now to FIG. 5, an assembled sabot projectile 55 is shown which comprises a sabot 24 and a projectile core 10 placed therein. Cavity projectile core 10 contains a tracer charge 56 and an ignitor 57 (behind the tracer charge), to provide a tracer trail 58 following their ignition by propellant gun gases generated during launch. Although FIG. 5 shows the tracer trail 58 coming out while the ignitor is still intact and while the sabot 24 is still intact, as would be the case while projectile 55 passes through a gun barrel. In actual operation, the ignitor 57 is intended to ignite of the tracer charge 56 at a predetermined time following launch by which time the core 10 will have separated from the sabot 24 and by which time ignitor 57 will have been consumed.

Sabot projectile 55 is loaded into a conventional or modified 0.50 caliber cartirdge case with a suitable propellant such as the spherical propellant manufactured by Olin Corporation at St. Marks, Fla., so that projectile core 10 achieves a sufficient velocity to match the trajectory of a 0.50 caliber saboted light armor penetrator round.

It should be noted that membrane 44 and seal surface 50 combined to produce a traced sabot projectile which has a sealed tracer charge so that tracer charge is not unduly affected by the environment prior to launch and annular gas seal 22 helps to prevent propellant gases from destroying the sabot by blowing through spin-up notches 20 during launch. This method of sealing tracer material from environment obviates requirement for separate closure such as a plastic or metallic cup or dish commonly used in tracer bullets. Advantages are reduced manufacturing cost and greater available volume for increasing quantity of tracer.

To prove the operability of the invention, 10 rounds were fabricated, loaded according to the invention and fired for velocity and accuracy. As a comparison, 10 rounds were fabricated with a convention spin-up notch which went completly across the rear end surface of the projectile core is parallel to its base, in conventional manner. All of the sabots containing the control projectiles failed during in-bore acceleration while none of the projectiles made according to the invention failed during launch. A sabot failure results in a very low penetrator velocity being obtained and very poor accuracy of the penetrator.

While the invention has been described in terms of a preferred embodiment, modifications within the scope of the following claims can be made while still achieving the advantages of the invention.

What is claimed is:

1. A traced sabot projectile which comprises:

a hard metallic penetrator core having:

a forwardly tapered forward end;

a cylindrical rear portion defining a central rearwardly open tracer cavity;

a tracer charge within the tracer cavity;

a flat annular rear surface orthogonal to the axis of the core;

at least one spin-up on said rear surface;

a cylindrical generally forwardly opening cup-shaped rigid plastic sabot coaxial with and surrounding the rear surface and rear portion of the core and having:

an annular sealing surface disposed radially between the spin-up notch and the tracer cavity so as to prevent gas escape from said tracer cavity through said notches;

a cylindrical wall defining a forwardly opening cavity adapted to receive the core;

a metallic support plate having a central passageway passing axially therethrough, the plate being located at and forming a closed base of the cavity and the plate being symmetrical about its axis, its axis being aligned coaxially to the axis of the core;

a base portion attached to the rear of the cylindrical wall and having at least one passageway axially therethrough from the rear to the front of the base portion, the passageway of the sabot having a diaphragm thick enough to seal the tracer charge from the environment prior to launch but thin enough to be destroyed by propellant gas pressure during launch so as to allow the propellant gases to pass through the passageway in the sabot base to ignite the tracer charge; and said plastic sabot being made of a plastic material with an Izod impact strength of less than 12 ft. lbs./in. of notch when tested under ASTM Test Method D256, a compressive strength of at least 15,000 psi when tested under ASTM Test Method D695, a shear strength of at least 12,000 psi when tested under ASTM Test Method D732 and a tensile strength of at least 12,000 psi when tested under ASTM Test Method D1708.

2. The sabot projectile of claim 1 wherein there are at least two notches on said rear surface and located symmetrical with respect to the longitudinal axis of the projectile core.

3. A traced sabot projectile which comprises:

(a) a hard metallic penetrator core having:

a forwardly tapered forward end;

a cylindrical tubular rear portion defining a central rearwardly open tracer cavity;

a tracer charge within the tracer cavity;

a flat annular rear surface orthogonal to the axis of the core;

at least one spin-up notch on said rear surface; and the notch being axially deeper at its outward radial end than at its inner radial end, so as to allow the inner end of the notch to be sealed against the support plate during launch, whereby to prevent gas flow into the sabot cavity through the notch;

(b) a plastic sabot having:

a cylindrical wall defining a forwardly opening a cavity adapted to receive the core;

a base portion attached to the rear of the cylindrical wall and having at least one passageway axially therethrough; and said sabot being made of a plastic material with an Izod impact strength of less than 12 ft. lbs./in. of notch when tested under ASTM Test Method D256, a compressive strength of at least 15,000 psi when tested under ASTM Test Method D695, a shear strength of at least 12,000 psi when tested under ASTM Test Method D732 and a tensile strength of at least 12,000 psi when tested under ASTM Test Method D1708.

(c) a metallic support plate having a central passageway passing axially therethrough, the plate being located at and forming a closed base of the cavity and the plate being symmetrical about its axis, its axis being aligned coaxially to the axis of the core.

4. The sabot projectile of claim 3 wherein there are at least two spin-up notches on the rear surface of the core and located symmetrically about the axis of the core.

5. The sabot projectile of claim 4 wherein the tracer cavity is cylindrical and of a larger diameter than the diameter of the passageway in the sabot, so as to allow the sabot to support the tracer charge during launch.

6. The sabot projectile of claim 2 therein the cylindrical wall of the sabot has a plurality of longitudinally extending petals extending axially along an inner surface of the sabot whereby to leave a circumferentially continuous outer bourrelet surface on the sabot to increase obturation and decreasing balloting, each petal being separated by a weakened section extending longitudinally only along a major front portion of the axial length of the inner surface between each pair of adjacent petals.

7. The sabot projectile of claim 6 wherein the cylindrical wall has a continuous cylindrical inner surface adjacent the base of the forward opening sabot cavity for sealing against rear portion of the penetrator to help seal the tracer charge from the environment prior to launch.

8. The sabot of claim 6 wherein each of said sabot petals has a circumferentially weakened section to predetermine the location of petal separation from the sabot during sabot disintegration following launch.

9. The sabot of claim 8 wherein the weakened section are notches on the internal surface of the cylindrical wall of the sabot.

10. The sabot projectile of claim 9 wherein the sabot wall has a forwardly tapered front portion.

11. A small caliber ammunition sabot for launching a hard metallic core which sabot comprises:

a cylindrical wall defining a forwardly opening a cavity adapted to receive the core;

a metallic support plate having a central passageway passing axially therethrough, the plate being located at and forming a closed base of the cavity and the plate being symmetrical about its axis, its axis being aligned coaxially to the axis of the core;

a base portion attached to the rear of the cylindrical wall and having at least one passageway axially therethrough communicating with the passageway through the support plate;

a rupturable diaphragm in the passageway for sealing the passageway prior to launch but rupturing in response to gun gas pressure during launch so as to allow for ignition of any ignitable mixture which is in the rear of the core; and the wall, base portion and diaphragm being integrally molded of a plastic material with an Izod impact strength of less than 12 ft. lbs./in. of notch when tested under ASTM Test Method D256, a compressive strength of at least 15,000 psi when tested under ASTM Test Method D695, a shear strength of at least 12,000 psi when tested under ASTM Test Method D732 and a tensile strenth of at least 12,000 psi when tested under ASTM Test Method D1708.

12. The sabot projectile of claim 11 wherein the cylindrical wall of the sabot has a plurality of longitudinally extending petals each separated by a weakened section extending longitudinally between each pair of adjacent petals, the weakened sections extending axially only partially along an inner wall of the sabot and the section each having a rearwardly pointed rear end.

13. The sabot projectile of claim 11 wherein the cylindrical wall has a continuous cylindrical inner surface adjacent the base of the forward opening sabot cavity for sealing against rear portion of the penetrator to help seal the tracer charge from the environment prior to launch.

14. The sabot of claim 11 wherein said wall has a circumferentially weakened section adjacent the base portion to predetermine the location of petal separation from the sabot during sabot disintegration following launch.

15. The sabot of claim 13 wherein the weakened section are notches on the internal surface of the cylindrical wall of the sabot.

16. The sabot projectile of claim 14 wherein each of the petals has a forwardly tapered front portion.

17. A traced sabot projectile having a longitudinal axis which projectile comprises:

a subcaliber projectile core having a cylindrical rear portion with a tracer cavity open therein communicating with a rear end of the core;

a solid rigid plastic sabot having a cylindrical forward wall portion sealingly surrounding the rear portion and having a cylindrical rear base portion with at least one passageway communicating the rear of the sabot with the tracer cavity and having a waterproof rupturable seal in the passageway adapted to be ruptured by gun propellant gas pressure during lauanch of the projectile whereby said tracer cavity is waterproof sealed from the environment exterior of the projectile until launch but upon launch the seal is ruptured to allow ignition of the tracer charge during launch, thus, eliminating the need for a separate seal in the tracer cavity itself; and said sabot being made of a plastic material with an Izod impact strength of less than 12 ft lbs./in. of notch when tested under ASTM Test Method D256, a compressive strength of at least 15,000 psi when tested under ASTM Test Method D695, a shear strength of at least 12,000 psi when tested under ASTM Test Method D732 and a tensile strength of at least 12,000 psi when tested under ASTM Test Method D1708.

18. The sabot projectile of claim 17 wherein said seal is a plastic barrier molded integrally with the remainder of the plastic sabot.

* * * * *